US005786540A

United States Patent [19]

Westlund

[11] Patent Number: 5,786,540

[45] Date of Patent: Jul. 28, 1998

[54] CONTROLLER APPARATUS FOR MUSIC SEQUENCER

[76] Inventor: Robert L. Westlund, 39424 258th Ave. SE., Enumclaw, Wash. 98022

[21] Appl. No.: 612,012

[22] Filed: Mar. 5, 1996

[51] Int. Cl.[6] ..... G10H 1/38

[52] U.S. Cl. ..... 84/645; 84/669; 84/DIG. 22

[58] Field of Search ..... 84/609–614, 634–638, 84/645, 649–652, 666–669, DIG. 12, DIG. 22

[56] References Cited

U.S. PATENT DOCUMENTS

| | | | |
|---|---|---|---|
| 3,962,945 | 6/1976 | Creager et al. | 84/DIG. 22 |
| 4,129,055 | 12/1978 | Whittington et al. | 84/DIG. 22 |
| 4,226,154 | 10/1980 | Easler | 84/DIG. 22 |
| 5,166,467 | 11/1992 | Brown | 84/DIG. 22 |
| 5,223,655 | 6/1993 | Watanabe et al. | 84/669 X |
| 5,250,746 | 10/1993 | Saito et al. | 84/DIG. 22 |
| 5,430,244 | 7/1995 | Ruffcorn | 84/669 |
| 5,481,066 | 1/1996 | Kitamura | 84/637 |
| 5,502,274 | 3/1996 | Hotz | 84/645 X |
| 5,639,980 | 6/1997 | Imaizumi | 84/637 |

*Primary Examiner*—Stanley J. Witkowski
*Attorney, Agent, or Firm*—Jensen & Puntigam, P.S.

[57] ABSTRACT

The apparatus includes a plurality of foot-operated switches, each switch associated with a particular musical note in a selected octave. Additional switches are provided for tempo (beat control) and selection of minor and seventh chord variations. The apparatus includes a processor which produces messages, in response to the switch selections, which have a MIDI format wherein the messages are transmitted to any music sequencer which can use the information therein to produce the audio signals which when amplified and sent to speakers produce the musical chords which the selected switches represent.

15 Claims, 6 Drawing Sheets

MIDI NOTE VALUES FOR ELEVEN OCTAVES OF NOTES. MIDDLE C = 60.

| OCTAVE | SW | -5 | -4 | -3 | -2 | -1 | +1 | +2 | +3 | +4 | +5 | +6 |
|---|---|---|---|---|---|---|---|---|---|---|---|---|
| C | 11 | 00 | 12 | 24 | 36 | 48 | 60 | 72 | 84 | 96 | 108 | 120 |
| C# | 12 | 01 | 13 | 25 | 37 | 49 | 61 | 73 | 85 | 97 | 109 | 121 |
| D | 13 | 02 | 14 | 26 | 38 | 50 | 62 | 74 | 86 | 98 | 110 | 122 |
| D# | 14 | 03 | 15 | 27 | 39 | 51 | 63 | 75 | 87 | 99 | 111 | 123 |
| E | 15 | 04 | 16 | 28 | 40 | 52 | 64 | 76 | 88 | 100 | 112 | 124 |
| F | 16 | 05 | 17 | 29 | 41 | 53 | 65 | 77 | 89 | 101 | 113 | 125 |
| F# | 17 | 06 | 18 | 30 | 42 | 54 | 66 | 78 | 90 | 102 | 114 | 126 |
| G | 18 | 07 | 19 | 31 | 43 | 55 | 67 | 79 | 91 | 103 | 115 | 127 |
| G# | 19 | 08 | 20 | 32 | 44 | 56 | 68 | 80 | 92 | 104 | 116 | ---- |
| A | 20 | 09 | 21 | 33 | 45 | 57 | 69 | 81 | 93 | 105 | 117 | ---- |
| A# | 21 | 10 | 22 | 34 | 46 | 58 | 70 | 82 | 94 | 106 | 118 | ---- |
| B | 22 | 11 | 23 | 35 | 47 | 59 | 71 | 83 | 95 | 107 | 119 | ---- |

FIG.4

FIG.5

ARITHMETIC RELATIONSHIP OF VALUES FOR THE THREE CHORD NOTES FOR MAJOR, MINOR AND SEVENTH TYPE CHORDS.

| CHORD | NOTE N1 | NOTE N2 | NOTE N3 |
|---|---|---|---|
| MAJOR | ROOT | ROOT + 4 | ROOT + 7 |
| MINOR | ROOT | ROOT + 3 | ROOT + 7 |
| SEVENTH | ROOT | ROOT + 4 | ROOT + 10 |

CONTROLLER APPARATUS FOR MUSIC SEQUENCER

TECHNICAL FIELD

This invention relates generally to music sequencers and associated apparatus, and more particularly concerns a controller for music sequencers, wherein the controller produces music instrument digital interface (MIDI) signals to control a music sequencer.

BACKGROUND OF THE INVENTION

Accompaniment musical instrumentation, used either with instruments or to accompany a singer, are generically referred to as music sequencers and are generally well-known. A music sequencer, in combination with an associated amplifier and speakers, produces various prerecorded musical sounds, rhythms, patterns and songs, selected by an operator/performer. The tempo of the music so produced can also be controlled by the performer. Typically, various controls are positioned on the front of the music sequencer to facilitate the performer's selection of the desired musical pattern or rhythm. Various rhythms are usually available, including classical, rock, jazz, Caribbean and new age, among others. In addition, the specific chords comprising the desired musical pattern can be selected, as well as introduction and ending portions. Music sequencers are used by keyboard performers, such as pianists, and also by string and wind instrument performers, as well as vocalists.

The digital signals used in the music sequencer conform to a music instrument digital interface specification, and are generally known as "MIDI" signals. The music sequencers themselves are sometimes referred to as MIDI devices. As indicated above, the music sequencers produce electrical signals which are amplified and then used to drive speakers which produce the audible musical sounds. Music sequencers can also output MIDI signals directly which are then applied to a follow-on music sequencer, in a cascaded effect.

In addition to the music sequencer itself, which, as indicated above, is programmed to produce the desired accompaniment in combination with amplifiers and speakers, associated devices are sometimes used to provide a remote control function. Using particular timing and note combinations, automatic chording or patterns can be produced. However, there are many instances where it is not possible for a performer to make the necessary control selections at the times required by the sequencer and at the same time actually play an instrument (such as piano or accordion). For instance, a desired three-note chord selection is needed by the sequencer at the precise time that a sequencer pattern is to begin, so that the notes of the prerecorded pattern can be adjusted in pitch to harmonize with the desired chord. This may be physically impossible for the performer. Also, random chord changes are difficult for the performer to initiate while at the same time playing an instrument requiring two hands.

A pedal board is provided by some music sequencer manufacturers as a form of remote control. However, such pedal boards are typically designed for use with a particular sequencer and involve simple switch closures which interface with the sequencer through a multi-pin connector instead of providing MIDI-type signals which can be used directly by the music sequencer processor. Such pedal board devices thus simply circumvent the front panel controls of the music sequencer. The complexity of the control functions is not changed in such an arrangement. slider and the on/off switch, as well as the display, are conventional in structure and operation.

FIG. 2 shows a block diagram of the complete apparatus. The selector switches 11–25 are shown representationally, including switches which represent the 12 notes in one octave of the standard musical scale. Switches 24 and 25 are for minor or seventh chord selections. Slide switch 26 determines the tempo of the musical pattern produced by the sequencer.

The apparatus includes a processor 30, which in one embodiment could be a conventional microprocessor, run by a stored software program in ROM, with RAM data storage, and various registers. Processor 30 repetitively scans switches 11–25 through the action of a multiplexer interface 32. As indicated above, each musical note in a selected octave is associated with one selector switch. The particular note selected is used as the root of a three-note chord "message" generated by the processor in the controller, which message is then transmitted to the music sequencer. The software in the processor determines the three notes forming a chord, from the one note selected. The message provided to the music sequencer causes it to produce either a chord signal or a signal which results in a sequence of instrument sounds which harmonize with the selected three note chord. This is described in more detail in connection with FIG. 3.

In addition to those switches which are associated with a particular musical note or chord, the switches for minor or seventh chords are also recognized by the processor 30 through multiplexer interface 32. The three note messages produced by the processor will vary, depending upon whether the desired chord is a minor chord, a seventh chord or a major chord. If neither the minor nor seventh chord switches are activated, the chord is a major chord, as a default occurrence.

In the embodiment shown, there are spare (additional) switches which can be used for other types of chords or additional sequencer control functions such as rhythm pattern introduction selection. Processor 30, besides determining the three particular notes which form the desired chord from the one selected note, will generate several MIDI command signals, referred to as MIDI "messages", including start, stop, clock, note-on and note-off messages, among others, which are all coded to the MIDI specification format.

The MIDI messages from the processor are applied to a UART (universal asynchronous receive and transmit) interface 34 and then to a standard MIDI line driver circuit 36. The output of line driver 36 is applied to a conventional MIDI connector 38 for connection via a standard MIDI interface cable 27 to the music sequencer 28. The music sequencer 28, upon receipt of a MIDI message, will identify the three musical notes in the message, and through its standard circuitry, will produce audio signals which are then amplified and applied to conventional speakers to produce musical sounds in the form of chords or a sequence of instrument sounds.

With the processor of the present invention, an external MIDI clock "message" can be supplied to the music sequencer to establish the tempo of the music produced. This is accomplished by a variable frequency oscillator 42 with a manual control (switch 26 in FIG. 1). The oscillator frequency is applied to a logic converter 46 which in turn is used to drive an LED display 29 in the embodiment shown which will display the tempo on a "beats per minute" basis to the performer. Typically, the range of tempo is between 24 and 240 beats per minute.

The output of oscillator 42 is also applied to a frequency divider 50 which drives a clock generator 52. The clock generator 52 provides interrupt pulses Further, some foot pedal arrangements generate only a single note, not a chord, and hence do not provide the capability of typical music sequencer front panel controls. Such arrangements do not solve the problem of those performers who are unable to operate the required multiple controls of a music sequencer to produce the desired chords while at the same time playing their musical instruments in a normal manner.

DISCLOSURE OF THE INVENTION

Accordingly, the present invention is an apparatus for controlling a music sequencer, comprising: a switch means which comprises a plurality of individual switches which may be set by an operator/performer, wherein each switch represents a musical note which in turn is associated with a particular musical pattern, such as a chord; processing means for scanning said switches, responsive to closure of one of said switches associated with a particular musical chord, to produce a message in a particular format recognizable by music sequencers which will cause the music sequencer to produce signals which can in turn be used to produce said musical chord audibly; and means for transmitting said message to the music sequencer.

BRIEF DESCRIPTION OF THE DRAWINGS

FIG. 4 is a table showing correlation of switch closures to MIDI note values 0–127, which cover eleven musical octaves (−)5 to (+)6.

FIG. 5 is a table showing the combination of musical notes for various chords.

BEST MODE FOR CARRYING OUT THE INVENTION

Figure 1:
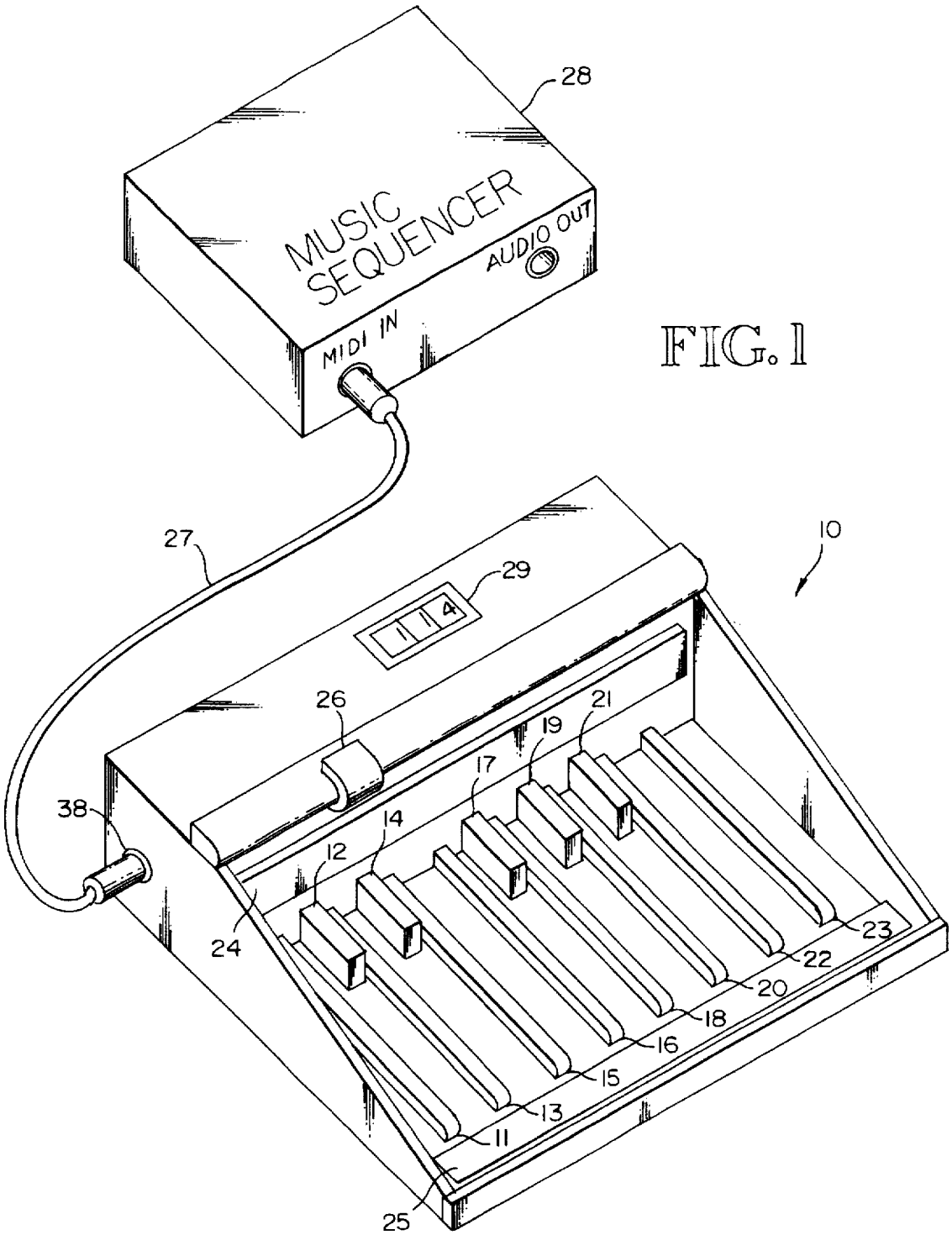
FIG. 1 is a perspective view of the apparatus of the present invention.

Referring now to FIG. 1, the present invention generally is a controller which produces MIDI control signals (messages) for input to music sequencers. The desired chords and tempo to be produced by the music sequencer (in combination with an amplifier and speakers) are selected by the performer by operation of a series of foot-operated switches in the controller. A performer thus can play his/her instrument with both hands, while selecting the desired rhythm accompaniment through the foot-actuated switches. The controller includes a microprocessor, under software control, to produce MIDI control signals which are applied directly to the music sequencer.

In the present invention, the apparatus 10 includes a bank of 15 separate selector switches 11–25, each of which can be conveniently operated by foot or hand. There are sufficient switches such that each of the musical notes in a single octave is uniquely associated with a switch. Switches 24 and 25 are provided to permit selection of a minor chord or a seventh chord. If neither the minor chord or seventh chord switches are operated, the result by default is a major chord.

Further, there is a slide switch 26 to control the tempo of the musical pattern to be produced by the music sequencer, while a display 29 produces a visual indication of the tempo. In addition, an on/off control switch (not shown) for the controller can be included. All of the individual foot switches, including the through NAND gate 54 to AND gate 58 and then to processor 30. UART 34 also provides interrupt pulses to processor 30, through NAND gate 56, the output of which is applied to the other input of AND gate 58.

Processor 30 selectively accepts interrupts by providing "enable" pulses to NAND gates 54 and 56. The interrupt pulses from clock generator 52 have a repetition rate in the range of 10 to 100 pulses per second. At the occurrence of each such clock interrupt, the processor generates a MIDI clock message. 96 MIDI clock messages comprise one music measure according to MIDI specifications. The interrupt from clock generator 52 is also used by the software in the processor 30 to initiate and control the stop sequence of the music. The UART interrupt indicates to the processor that it can accept more data messages or that it is full, thus controlling the rate of data flow from the processor.

Figure 3:
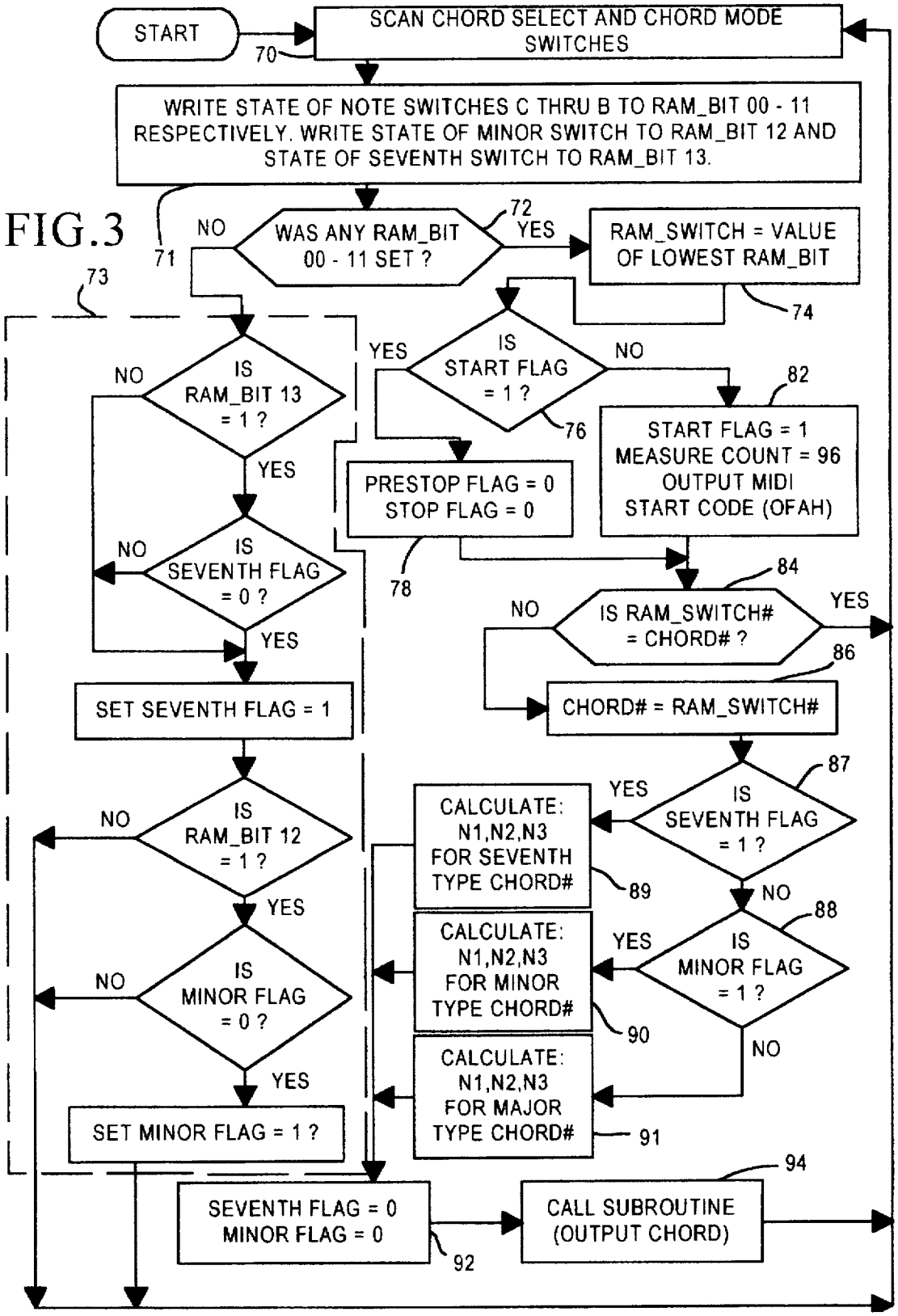
FIG. 3 is a software flow chart used for the invention of FIG. 1.

FIG. 3 is a flow chart for the main software program for the present invention. As discussed above, the state of each of the plurality of selector switches 11–25 is scanned repetitively by microprocessor 30. This is shown at block 70. The state of each selector switch is stored in a RAM switch register (block 71) in microprocessor memory. The switches for the 12 musical notes C through B (one octave) are set in bits 00–11 while the switches for the minor and seventh chords are set in bits 12 and 13.

The state of the register bits 00–11 is then interrogated to see whether any bit has been set to 1, indicating the activation of a particular musical note switch. This is shown in block 72. If none of RAM bits 00–11 have been set, then RAM bits 13 and 12, representing the seventh chord switch and minor chord switch are interrogated. If either bit 13 or bit 12 is found to be 1, then the corresponding software flag, indicating selection of a seventh of minor flag, is set for subsequent use by the program. The routine then loops back to block 70, as discussed in more detail below. If any of the 00–11 RAM bits is found to be equal to 1 (block 72), the RAM switch is set to the number of the lowest bit (the lowest switch in the sequence) which is equal to 1. This is shown at block 74.

The start flag register is then interrogated, as shown at block 76. If the start flag is already 1, it indicates that a start message has been sent to the music sequencer and hence should not be repeated. The stop flag and pre-stop flag are then both cleared to zero, at block 78, and the software then moves to block 84. On the contrary, if the start flag is zero, then, as shown in block 82, the start flag is set to 1, a "measure count" counter is set to 96 and the start message is sent to the music sequencer.

Figure 2:
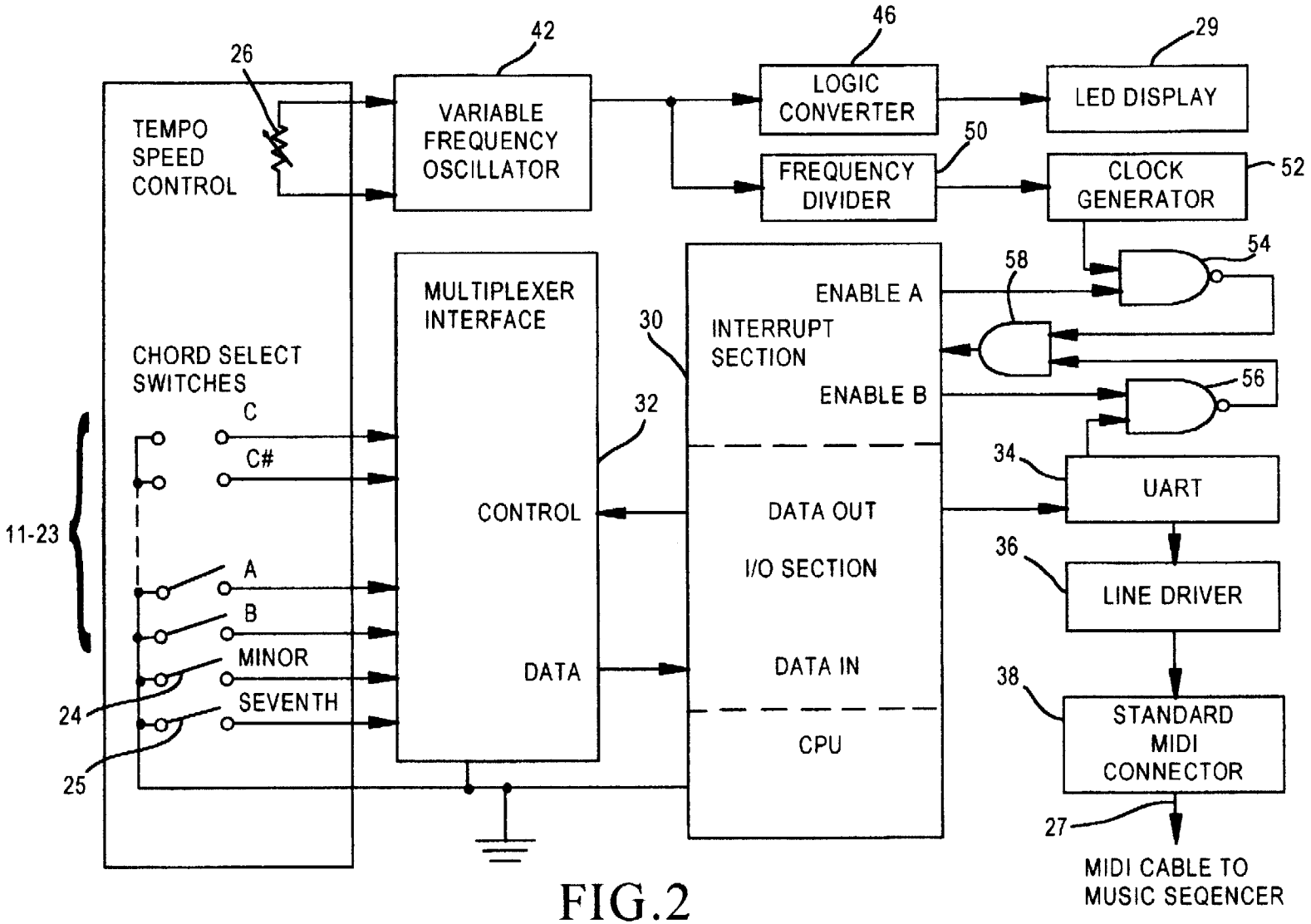
FIG. 2 is a block diagram of the controller of the present invention.

If the sequencer had previously received a stop message, a preselected music sequence will now be started. The stop routine is explained in more detail below. Briefly, the "stop" music sequence runs for at least one measure, controlled by the "measure count" counter being set to 96, which is the number of clock messages in a music measure. In operation, the measure count counter is decremented each time the microprocessor receives an interrupt from clock generator 52 (FIG. 2). This enables the microprocessor to determine the precise point of music sequencer operation within the current measure.

The above program steps concern the generation of the start message for the music sequencer. Following the start message, a chord message is generated. The RAM switch value (block 74) is interrogated in block 84. If this value is the same as the present chord, then there has been no change to the previous state of the select switches and the program returns to scan the set of select switches at block 70.

If the RAM switch is not equal to the present chord value, then the software generates new chord instructions for transmission to the sequencer. This sequence is shown in blocks 87–91. First, the "seventh" chord software flag is examined to determine whether a seventh chord has been selected. This is shown at block 87. If not, the "minor" software flag is checked to determine whether or not the chord to be generated is a minor chord, as shown at block 88. If neither of those flags have been set then there is a default to a major chord condition. Thus, blocks 87 and 88 determine which one of the follow-on blocks 89, 90, and 91 are used.

Blocks 89, 90 and 91 generate three note messages for each type of chord. The relationship of notes N1, N2 and N3 for each chord type is shown in FIG. 5. Each of the select switches 11–22 representing musical notes has an associated MIDI note number as shown in FIG. 4. For instance, the musical note "C", associated with switch 11, has a MIDI note numbered 00 for octave (–5), 12 for octave (–4) and so on, in increments of 12, up to 120 for octave (+6). The musical note (such as C) selected by the performer is the primary or basic note for the resulting three-note chord.

For purposes of this description, the processor is assumed to generate MIDI note numbers in the lowest (–5) octave, and the music sequencer is set to accommodate these note numbers. A typical music sequencer can work with all the octaves shown above. The above range of MIDI note numbers in the embodiment shown extends to the (+6) octave. The range of note numbers can be fixed for a particular application and can be made variable by using switches which are readable by the processor.

As discussed above and shown in FIG. 5, the three-note chords are each based on the base or "root" note, which is the musical note associated with the particular select switch operated by the performer. The root musical notes for each select switch are shown in FIG. 4, and is explained above for switch No. 11 (musical note C). Each three note chord is produced by an arithmetic procedure relative to the root note. For a major chord, the three notes will be: (1) the note associated with the switch selected (the root note), which has a corresponding root note MIDI number (FIG. 5); (2) the note associated with the root note MIDI number plus 4; and (3) the note associated with the root note MIDI number plus 7. Thus, from FIGS. 4 and 5, the three note major chord for switch number 11 will be notes C, E and G.

For a minor chord, the three musical notes are the root note, which has a corresponding root note MIDI number, the note associated with the root note MIDI number plus 3, and the note associated with the root note MIDI number plus 7, i.e. for switch 11, the musical notes will be C, D♯ and G. For a seventh chord selection, the three notes are the root note, which has a corresponding MIDI number, the note associated with the root note MIDI number plus 4, and the note associated with the root note MIDI number plus 10, i.e. for switch number 11, the musical notes are will be C, E and A♯.

If the desired musical notes are in higher octaves, then all of the individual MIDI note members are simply incremented by a factor dependent on the octave to obtain the MIDI note numbers in the desired octave. The factor will be some multiple of 12, depending upon the particular octave desired.

Referring again to FIG. 3, in block 92, the seventh flag and the minor flag designations are cleared to zero regardless of their current state, so that the next chord selected will default to a major chord unless a minor or seventh chord is selected prior to operation of a particular chord switch.

Figure 6:
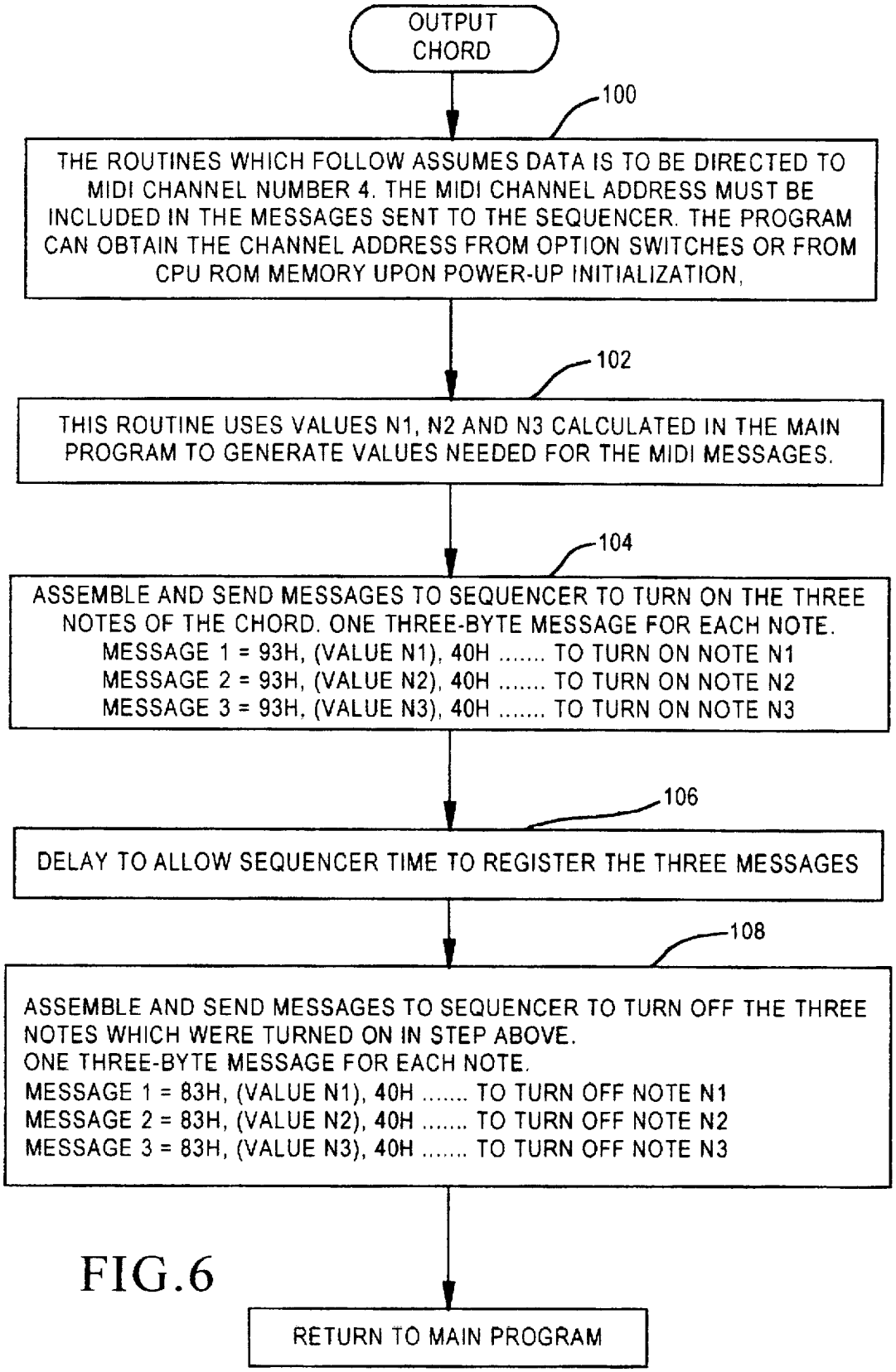
FIG. 6 is a flow chart showing in more detail one subroutine of the software used in the present invention.

In block 94 of FIG. 3, the output subroutine to the music sequencer is called. FIG. 6 shows the program flow for that output subroutine. In the embodiment shown, the MIDI message sent to the music sequencer for each chord consists of three three-byte data strings. Each note of the three-note chord is sent in a three-byte message. Byte 1 of each three byte string is a status address byte. Bytes 2 and 3 contain the content of the message, specifically the musical note and the volume of the note. In a particular illustration, using "hex" coding, where the "note-on" message is 93 H in hex and the "note-off" message is 83 H in hex, a message for turning on the first note of a C♯ chord will be 93 H, 01 H (first note value) and 40 H, where 40 indicates that the volume is at approximately one-half of full volume for the first note of the chord. Similar data strings are produced for the second and third notes. When the chord notes are to be turned off, the volume designation of 40 H refers to a "medium" sustain message for the note to fade away.

Referring specifically to FIG. 6, block 100 refers to the proper channel address for communicating the desired message to the music sequencer. The software determines the desired MIDI channel number by reading selected switches during program initialization, and then the channel remains fixed until the next program initialization sequence. Block 102 refers to the generation of the three notes N1, N2 and N3 for the three-note chord selected by the performer, while block 104 refers to the assembly and transmission of the three-byte data strings for each note, to turn the note on. In the hex coding shown in FIG. 6, in block 104 for the first byte of message 1 (for the first note), the numeral 9 is a code for note-on, while 3 H is the address associated with the selected MIDI channel number 4. These values, of course, can be varied depending upon the particular channel and its associated address. This is followed by the hex value for note N1 and then 40 H for the volume designation. Messages 2 and 3 are the same as for message 1, except for the values for musical notes N2 and N3.

After a pause, shown at block 106, usually of a few milliseconds, which permits the music sequencer to receive and act upon the transmitted messages, three additional messages are composed and sent to the music sequencer, which result in the three notes being turned off as shown in block 108. These messages are identical to the messages previously sent to turn on the notes, except the first byte in each message will be 83 H, which is a message to turn off the notes, with a sustain as indicated in the last byte.

Figure 7:
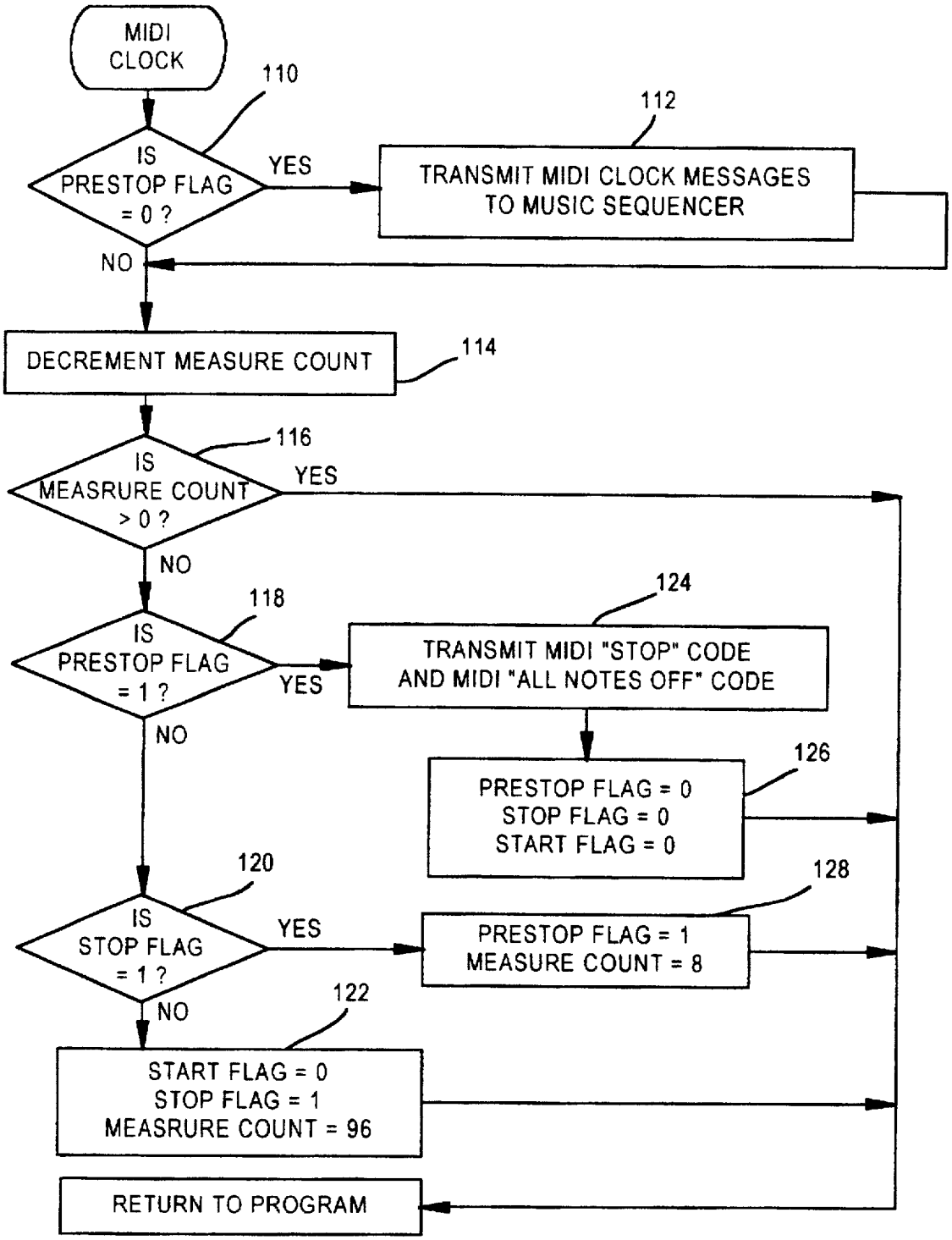
FIG. 7 is a flow chart showing another subroutine of the software used in the present invention.

FIG. 7 shows the software flow chart for the interrupt subroutine. The interrupt subroutine executes whenever a clock pulse interrupts the microprocessor. During normal operation, the pre-stop flag is zero and the MIDI clock messages are sent to the music sequencer (block 112). Each clock message will decrement the measure count counter, at block 114, indicating the number of clock messages left in the current measure. As indicated above, the measure count counter is loaded with the value 96, which equals a full measure's worth of clock messages. The measure count counter is interrogated (block 116), and if it is greater than zero, then the routine terminates and returns to where the program was when the interrupt occurred.

As long as a chord select switch is operated, the "measure count" counter will be reset to 96 and operation of the music sequencer will continue. When the pre-stop flag is zero and the "measure count" counter has been decremented to zero (block 116), no chord select switch has been operated during the last previous music measure and blocks 118 and 120 will begin the automatic stop procedure. First, the stop flag is set to one and the measure count counter set to 96, at block 122; then, one measure (96 clock messages) later, the pre-stop flag is set to one, at block 128. During the last measure, when the pre-stop flag is zero, clock messages continue to be transmitted to the music sequencer. Further, each clock message decrements the measure count counter, as shown at block 114.

When the pre-stop flag is equal to one, following setting of the stop flag to one, the routine will stop the operation of the music sequencer by ceasing to send clock messages to it. The pre-stop flag is thus set to 1 (block 128) during the last beat of the last measure of the operation of the sequencer and holds the final note of the chord in an "on" condition for one additional beat, which is 8 clock messages, by setting the measure count counter to 8 (block 128).

Since the pre-stop flag is now set to 1, subsequent runs through the routine will decrement the measure count counter until it reaches zero, at which point a routine shown at block 124 executes, which results in the stop message and "all notes off" message being transmitted to the music sequencer, which brings it to a complete stop. Then, as shown in block 126, the pre-stop flag, the stop flag and the start flag indication are all cleared to zero. The main program is now resumed in an idle mode until a select switch is activated by the performer, and the start sequence begins, again as described above.

In operation, the apparatus of the present invention must first be connected to a music sequencer. One of the advantages of the present invention is that it is not associated with any particular music sequencer but can be used with basically any music sequencer device which operates with a conventional MIDI format. The connection between the present apparatus and the music sequencer includes conventional MIDI-type cables and connectors.

The music sequencer is set to accept externally supplied clock signals, typically by means of a switch on the sequencer itself; it is also set to its auto-chord or similar mode of operation. Other selections made on the sequencer include the note range for the chords, as well as the particular pattern selections desired.

While the apparatus of the present invention utilizes a foot-operated device, a similar hand-operated device can be used as well, with similar switch controls. As explained above, the apparatus starts the operation of the music sequencer when any select switch is activated and maintains the music sequencer producing the resulting chord sequence as long as that switch is held. Absence of a switch being actuated for the duration of one music measure will cause the apparatus to bring the music sequencer to a stop, in the manner discussed above.

The apparatus is capable of generating major, minor or seventh chords as discussed in detail above. Major chords are produced in the absence of selection of the other chord types. Still other chords types can be implemented as desired. When a minor or seventh chord is selected, the resulting chord sequence will continue until that particular chord switch is released, at which point other chord types can again be selected.

Although a preferred embodiment of the invention has been disclosed herein for illustration, it should be understood that various changes, modifications and substitutions may be incorporated in such embodiment without departing from the spirit of the invention, which is defined by the claims which follow.

What is claimed is:

1. An apparatus for controlling a music sequencer which is separate from and independent of said apparatus and which is capable of accepting control signals from an external source, wherein said apparatus is not itself capable of producing audible music, comprising:

a switch means comprising a plurality of switches individually operable by an operator, each switch representing, respectively, a different musical note which is in turn associated with a preselected musical chord;

processing means for scanning said switches and responsive to closure of one of said switches which is associated with a particular musical chord to produce an output signal in the form of a control message in MIDI language format recognizable by music sequencers and representative of the musical chord, which will cause the music sequencer to produce signals which can in turn be used to generate audible accompaniment music in accordance with said preselected chord; and means for transmitting said message to the said separate music sequencer.

2. An apparatus of claim 1, wherein the switch means includes sufficient switches to cover all of the musical notes in one music octave.

3. An apparatus of claim 1, including chord selection means for selecting minor and seventh musical chords.

4. An apparatus of claim 3, wherein when the minor or seventh chord means are not selected, the musical chord is a major chord.

5. An apparatus of claim 2, including means for producing messages for the music sequencer which will result in musical chords in any octave from (−)5 through (+)5.

6. An apparatus of claim 1, wherein the processing means includes means for determining three musical notes comprising a chord from the one musical note associated with the particular switch selected by the operator, wherein the one musical note is one of the three musical notes comprising the chord and the other two notes are related to the one musical note in a preselected manner.

7. An apparatus of claim 1, including means for initiating a stop routine for automatically stopping the operation of the music sequencer upon release of the selected switch.

8. An apparatus of claim 1, including means for continuing to produce the musical chord for successive measures as long as the switch remains closed.

9. An apparatus of claim 7, wherein the means for automatically stopping the operation of the music sequencer includes means for continuing to produce the musical chord for any remaining portion of the measure after the switch has been released and a selected number of beats beyond the end of said measure.

10. An apparatus of claim 9, wherein said selected number of beats is one.

11. An apparatus of claim 9, including means for interrupting said stop routine upon closing of another switch.

12. An apparatus of claim 1, including means for varying the tempo of the music produced by the music sequencer.

13. An apparatus of claim 1, wherein the apparatus includes foot-operated means for setting the switches.

14. An apparatus of claim 1, wherein the apparatus includes hand-operated means for setting the switches.

15. An apparatus of claim 7, wherein said initiating means includes means for providing an interrupt signal to the processing means and to determine whether to implement operation of the stop routine at that time.

* * * * *